US009849569B2

(12) United States Patent
Su

(10) Patent No.: US 9,849,569 B2
(45) Date of Patent: Dec. 26, 2017

(54) CLENCH WRENCH

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 120 days.

(21) Appl. No.: 14/994,220

(22) Filed: Jan. 13, 2016

(65) Prior Publication Data

US 2016/0271763 A1 Sep. 22, 2016

(30) Foreign Application Priority Data

Mar. 18, 2015 (TW) ..... 104108634 A

(51) Int. Cl.

| | |
|---|---|
| ***B25B 13/46*** | (2006.01) |
| ***B25B 13/06*** | (2006.01) |
| ***B25B 23/00*** | (2006.01) |
| ***B25G 1/06*** | (2006.01) |

(52) U.S. Cl.

CPC ..... *B25B 13/463* (2013.01); *B25B 13/06* (2013.01); *B25B 23/0057* (2013.01); *B25B 23/0071* (2013.01); *B25G 1/063* (2013.01)

(58) Field of Classification Search

CPC ... B25B 13/06; B25B 13/463; B25B 23/0057; B25B 23/0071; B25G 1/063

USPC ..... 81/60

See application file for complete search history.

(56) References Cited

U.S. PATENT DOCUMENTS

| | | | | |
|---|---|---|---|---|
| 221,299 A * | 11/1879 | Gray | B60Q 1/2611 411/144 |
| 2,751,802 A * | 6/1956 | Reuillard | B25B 13/04 81/124.3 |
| 6,481,315 B1 | 11/2002 | Chang et al. | |
| 6,752,046 B1 * | 6/2004 | Lee | B25B 13/461 81/177.85 |
| 6,871,570 B1 * | 3/2005 | Santillan | B25B 13/461 81/125 |

(Continued)

FOREIGN PATENT DOCUMENTS

| | | |
|---|---|---|
| CN | 203566583 U | 4/2014 |
| TW | 551251 U | 9/2003 |

(Continued)

*Primary Examiner* — Hadi Shakeri
(74) *Attorney, Agent, or Firm* — Alan D. Kamrath; Kamrath IP Lawfirm, P.A.

(57) ABSTRACT

A clench wrench includes a structure defining a first body defining a handle and a second body integrated with the first body and defining an engaging head respectively. The second body has two opposite sides with one side defining a front side and the other side defining a back side respectively and includes an engaging space. The engaging space extends through the front and back sides, and an opening is defined on both the front and back sides. One of the front and back sides includes a clenching member of a clenching device connected thereto. The clenching member is selectively movable between a first position blocking the opening of the engaging space adjacent to one of the front and back sides and a second position in which the opening of the engaging space adjacent to one of the front and back sides is not blocked.

10 Claims, 6 Drawing Sheets

(56) References Cited

U.S. PATENT DOCUMENTS

| | | | | |
|---|---|---|---|---|
| 6,948,406 | B1 * | 9/2005 | Li | B25B 13/461 81/60 |
| 8,261,635 | B2 | 9/2012 | Lee et al. | |
| 9,393,676 | B2 * | 7/2016 | Weber | B25B 13/463 |

FOREIGN PATENT DOCUMENTS

| | | | |
|---|---|---|---|
| TW | M476030 | U | 4/2014 |
| TW | M492226 | U | 12/2014 |

* cited by examiner

CLENCH WRENCH

BACKGROUND OF THE INVENTION

1. Field of the Invention

The present invention relates to a wrench and, particularly, to a clench wrench.

2. Description of the Related Art

TW Pat. No. M476030 teaches a ratcheting box wrench. The wrench includes a ratchet wheel and an engaging hole adapted to receive the socket or an object to be wrenched and defined by an inner periphery of the ratchet wheel. The socket is prevented from disengaging from the wrench by a resilient C-clip. Likewise, the C-clip can be used to prevent the object to be wrenched from disengaging from the wrench. In order to receive the C-clip, a groove is defined by an outer periphery of the ratchet wheel, and a plurality of openings extends through the inner and outer peripheries of the ratchet wheel, such that the C-clip is partially disposed in the hole and can abut an outer periphery of the socket. In this regard, the ratchet wheel has a more complex design, and more costs and manufacturing processes are incurred. Furthermore, forcing the object to be wrenched, which is stuck in the hole, to disengage from the hole can easily cause the C-clip to disengage from the ratchet wheel. However, it is difficult to reengage the C-clip with the ratchet wheel. Furthermore, users often encounter difficulty to overcome the C-clip's restraining force to disengage the socket or the object from the hole if the socket or the object is too slippery to grasp.

The present invention is, therefore, intended to obviate or at least alleviate the problems encountered in the prior art.

SUMMARY OF THE INVENTION

According to the present invention, a clench wrench includes a body defining a first body defining a handle for a user of the clench wrench to grasp and a second body integrated with the first body and defining an engaging head respectively. The second body has two opposite sides, with one side defining a front side and with the other side defining a back side respectively and including an engaging space for engaging an object to be driven by the clench wrench. The engaging space extends through the front and back sides, and an opening is defined on both the front and back sides. One of the front and back sides includes a clenching member of a clenching device connected thereto. The clenching member is selectively movable between a first position blocking the opening of the engaging space adjacent to one of the front and back sides and being capable of preventing the object engaged with the engaging space from disengaging therefrom, and a second position in which the opening of the engaging space adjacent to one of the front and back sides is not blocked.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a clench wrench capable of preventing an object engaged therewith to disengage therefrom.

It is another objective of the present invention to allow a user to disengage the object from the clench wrench effortlessly.

Other objectives, advantages, and new features of the present invention will become apparent from the following detailed description of the invention when considered in conjunction with the accompanied drawings.

DETAILED DESCRIPTION OF THE INVENTION

Figure 1:
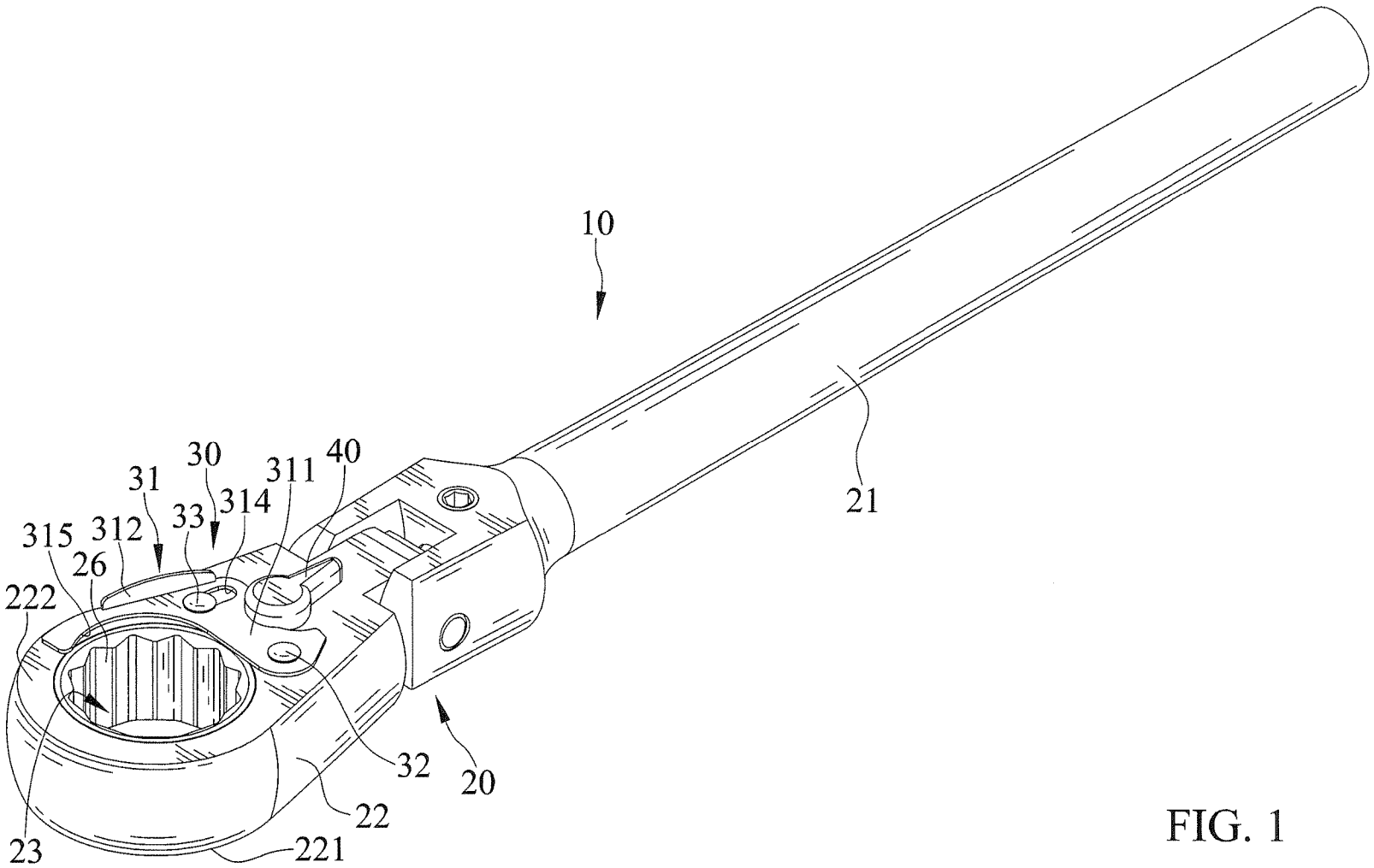
FIG. 1 is a perspective view of a clench wrench in accordance with the present invention.
Figure 2:
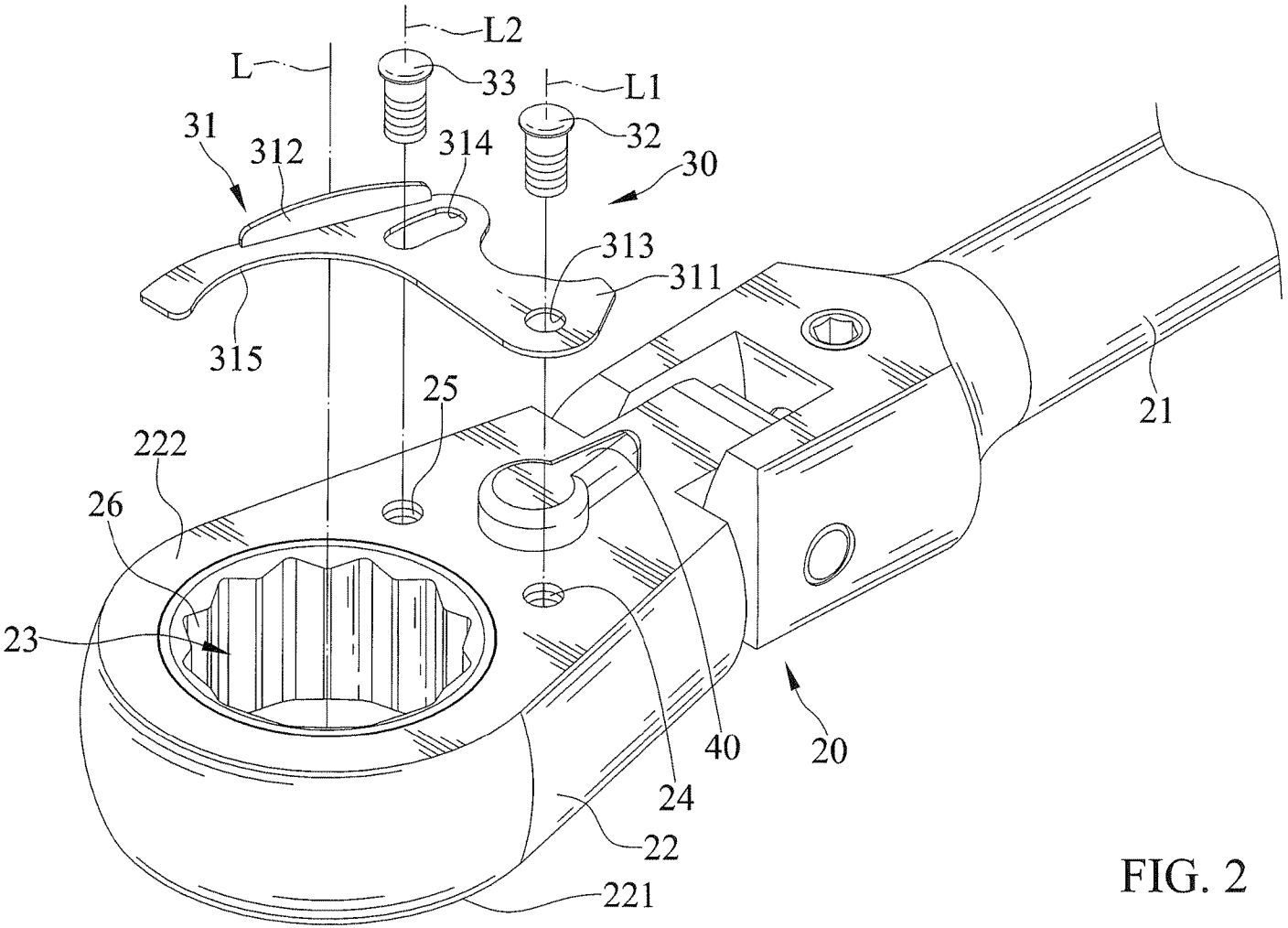
FIG. 2 is a partial exploded perspective view of the clench wrench of the present invention.
Figure 3:
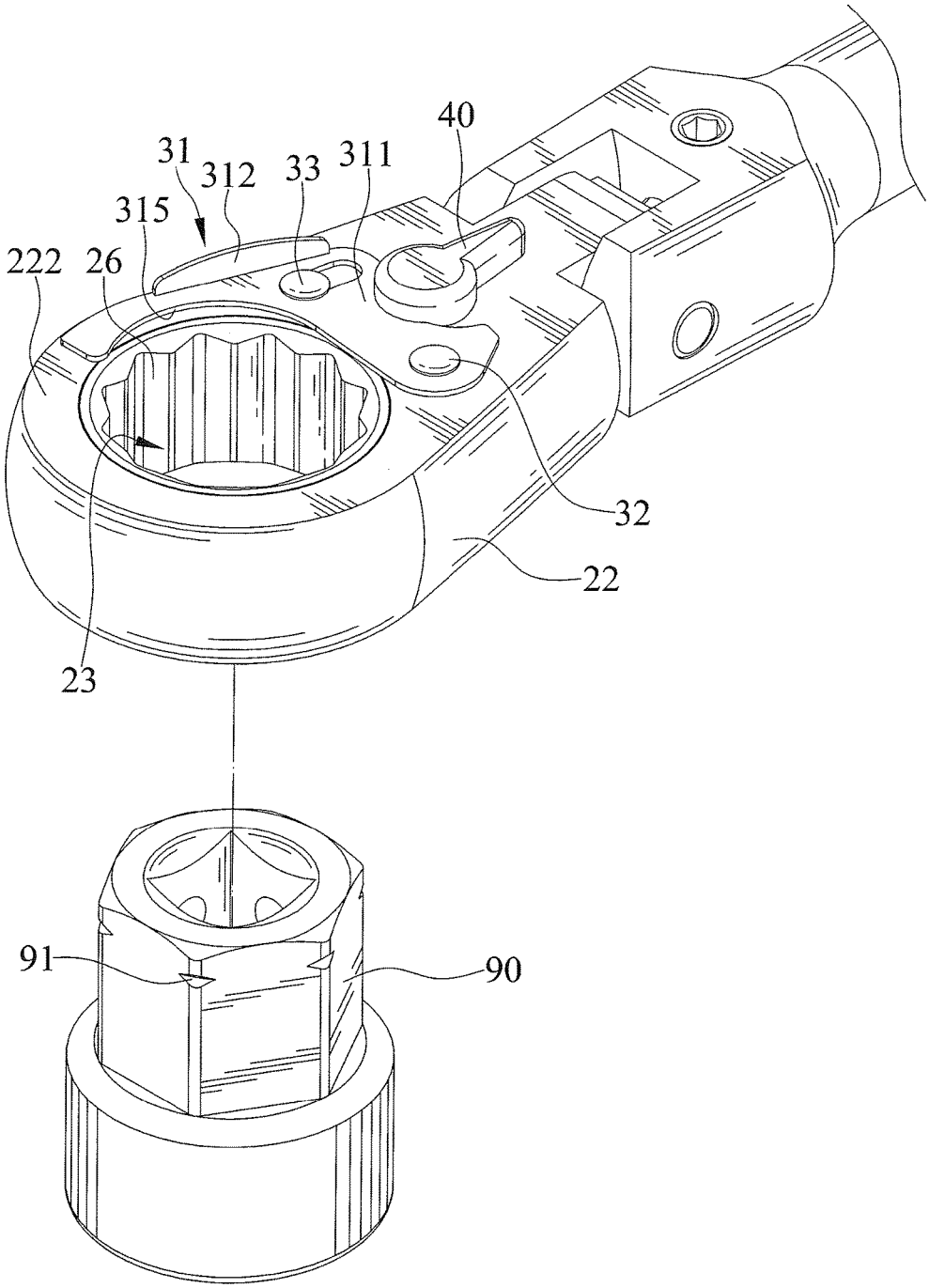
FIG. 3 is a perspective view of the clench wrench of the present invention and a socket to be engaged with the clench wrench.

FIGS. 1 through 6 show a clench wrench 10 in accordance with the present invention capable of preventing a socket or an object engaged therewith from disengaging therefrom.

The clench wrench 10 includes a structure 20 defining a first body 21 defining a handle for a user of the clench wrench 10 to grasp and a second body 22 integrated with the first body 21 and defining an engaging head respectively. The first and second bodies 21 and 22 are pivotally connected together. However, integrating the first and second bodies 21 and 22 as a one-piece structure is within the scope of the present invention.

The second body 22 has two opposite sides with one side defining a front side 221 and with the other side defining a back side 222 respectively. The distance between the front and back sides 221 and 222 defines the thickness of the second body 22. The second body 22 includes an engaging space 23 for engaging an object to be driven by the clench wrench 10. The engaging space 23 extends through the front and back sides 221 and 222, and an opening is defined on both the front and back sides 221 and 222. The engaging space 23 is defined by an inner periphery of a ratchet wheel 26. The ratchet wheel 26 is disposed in a compartment defined by an inner periphery of the second body 22. The ratchet wheel 26 is rotatable and has a center of rotation on an axis L. The axis L extends in a thickness direction of the second body 22. The inner periphery of the ratchet wheel 26 is polygonal, and ridges formed by the peripheral sides can facilitate turning of the object by the clench wrench 10.

One of the front and back sides 221 and 222 includes a clenching member 31 of a clenching device 30 connected thereto. The clenching member 31 is connected to one of the front and back sides 221 and 222 of the second body 22 by a pivot 32 of the clenching device 30 and is pivotal about a pivot axis L1, with the pivot 32 inserting through a through hole 313 defined by the clenching member 31 and fixed to a first engaging hole 24 defined by the second body 22. The clenching member 31 is a thin plate that has a substantially smaller thickness than a thickness of the second body 22. Therefore, the clenching device 30 is configured to avoid making the clench wrench 10 too thick or not compact. The pivot axis L1 is parallel to the axis L. The pivot 32 and the first engaging hole 24 are in thread engagement.

The clenching member 31 is selectively movable between a first position blocking the opening of the engaging space 23 adjacent to one of the front and back sides 221 and 222 and being capable of preventing the object engaged with the engaging space from disengaging therefrom, and a second position in which the opening of the engaging space 23 adjacent to one of the front and back sides 221 and 222 is not blocked. The clenching member 31 has a main body 311 selectively blocking the opening of the engaging space 23. The opening of the engaging space 23 is selectively blocked by a bottom side of the main body 311 as well as by a segment 315 of a lateral edge of the main body 311. The lateral edge extends upwardly from the bottom side and on a periphery of the bottom side.

Figure 4:
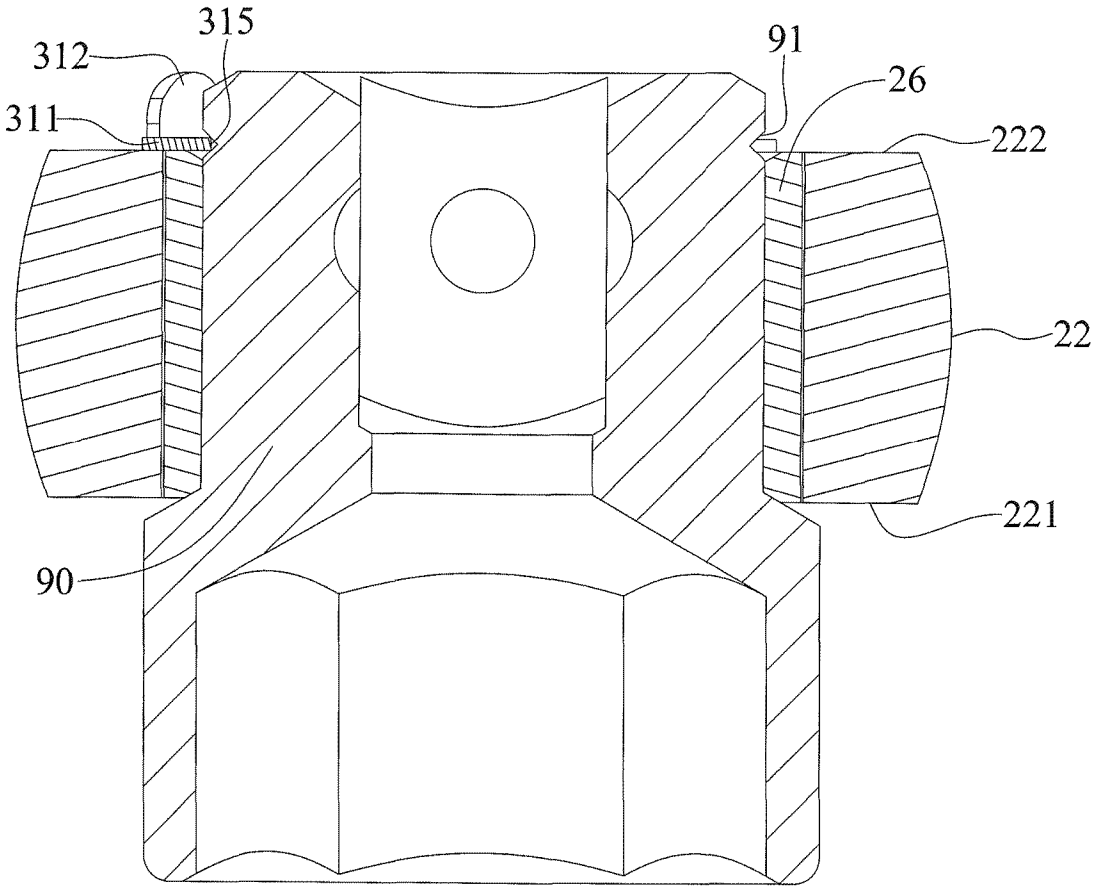
FIG. 4 is a cross-sectional view of the clench wrench of the present invention and the socket shown in FIG. 3, with the clench wrench preventing the socket from disengaging therefrom.
Figure 5:
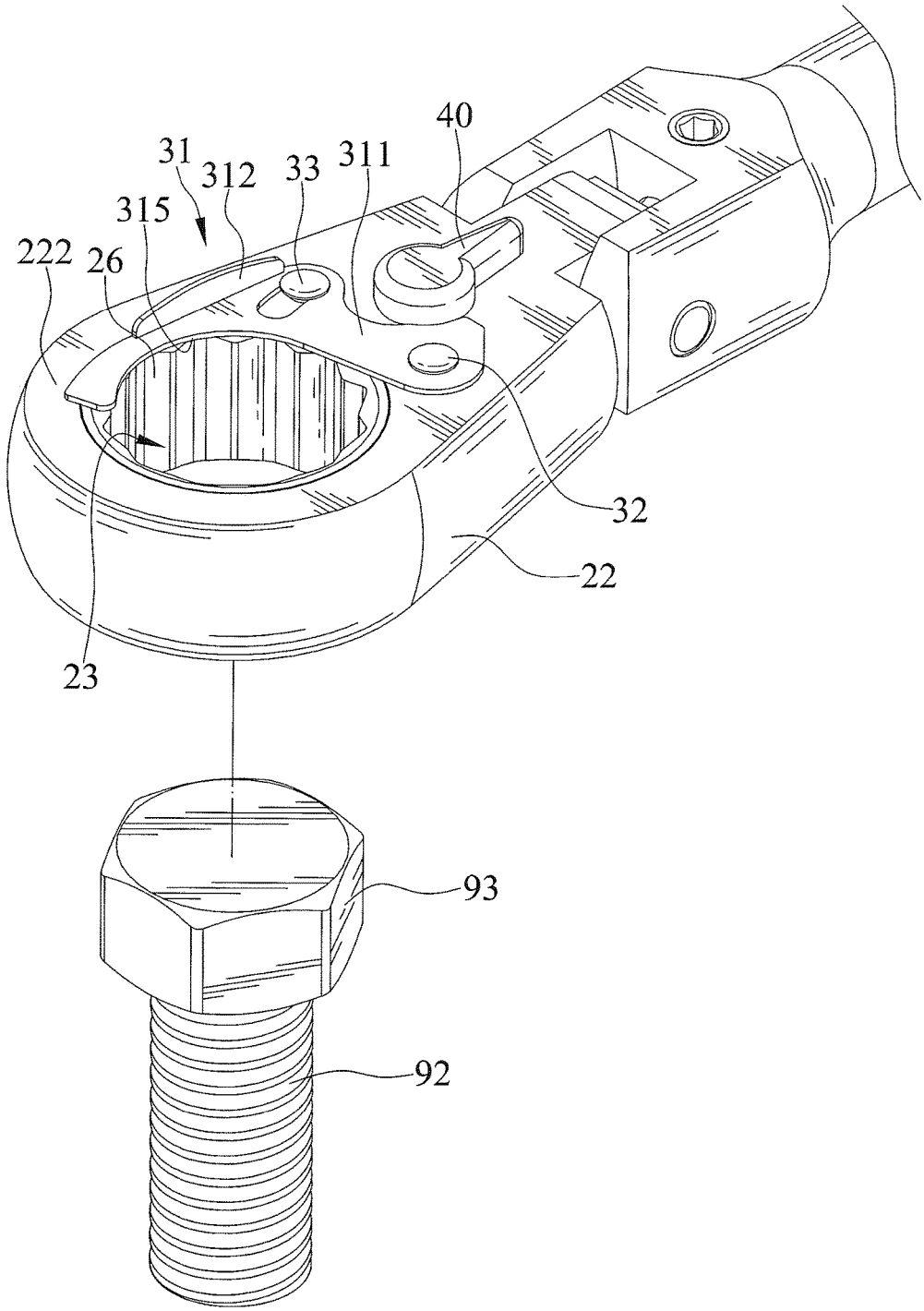
FIG. 5 is a perspective view of the clench wrench of the present invention and an object to be engaged with the clench wrench.

As shown in FIG. 4, a socket 90 is engaged with the clench wrench 10 and is prevented from disengaging therefrom. The socket 90 includes a joining end configured to be insertable into the engaging space 23. Furthermore, the socket 90 includes at least one recess 91 configured to be adapted to catch the segment 315 of the lateral edge of the main body 311 of the clenching member 31, such that the socket 90 is restrained by the segment 315 of the lateral edge of the main body 311 of the clenching member 31.

Figure 6:
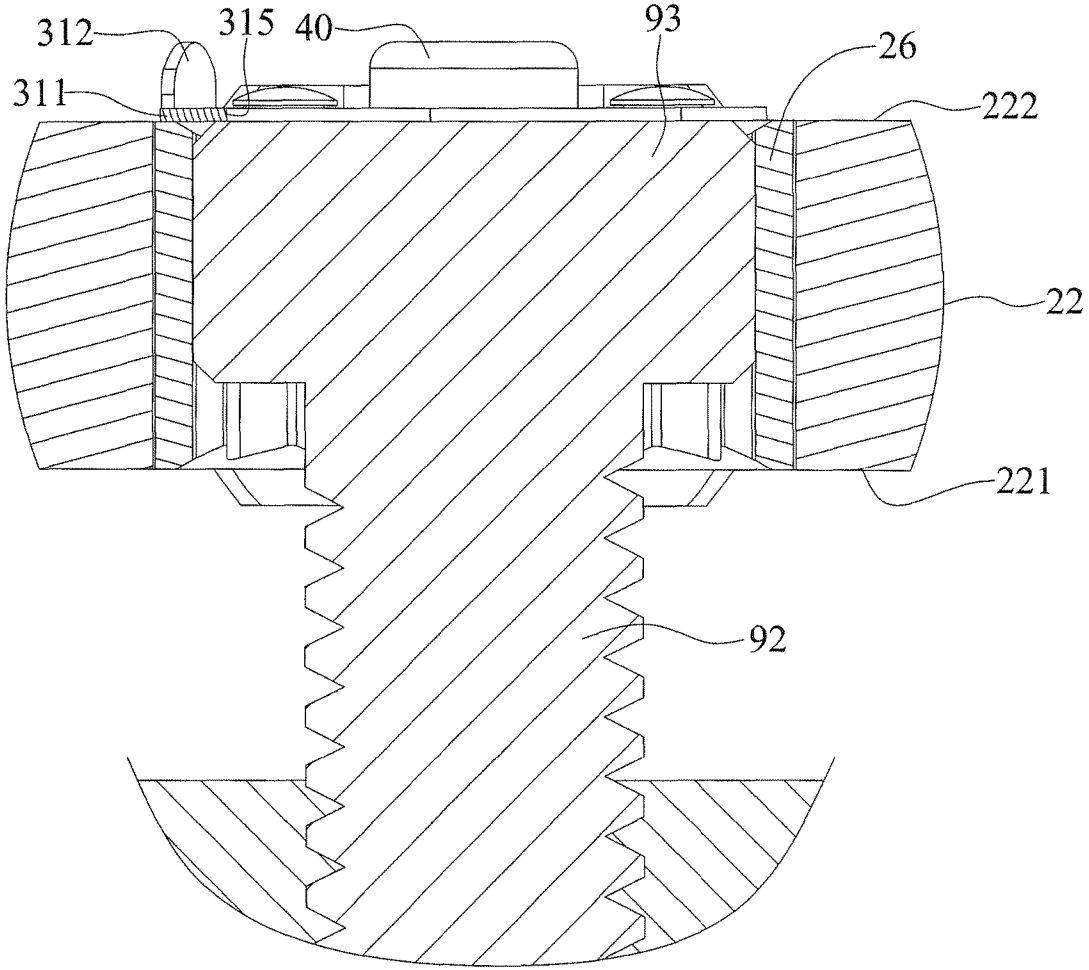
FIG. 6 is a cross-sectional view of the clench wrench of the present invention and the object shown in FIG. 5, with the clench wrench preventing the object from disengaging therefrom.

As shown in FIG. 6, an object 92 is engaged with the clench wrench 10 and is prevented from disengaging therefrom. The object 92 includes a head 93 configured to be insertable into the engaging space 23. The distal end of the head can be blocked by the bottom side of the main body 311 of the clenching member 31.

The clenching member 31 forms a lever 312 protruding upwardly from the main body 311 thereof. The lever 312 facilitates the operation of the clenching member 31.

A positioning device is interacted with the clenching device 30 and is configured to limit positions of the clenching member 31 between the first and second positions thereof. The clenching member 31 is limited by a limiter 33 of the positioning device, with the limiter 33 inserting through a groove 314 defined by the clenching member 31 and fixed to a second engaging hole 25 defined by the second body 22. The limiter 33 is disposed on an axis L2. The axis L2, the axis L and the pivot axis L1 are parallel to one another. The groove 314 is curved and elongated and has a center of curvature located on the pivot axis L1.

A switch device 40 interacts with the ratchet wheel 26 and is configured to releasably stop the ratchet wheel 26 from rotation. The switch device 40 includes an input control exposed on the second body 22. Therefore, a user of the clench wrench 10 can easily operate the switch device through the input control. Furthermore, the clenching member 31 has a thickness not greater than that of the input of the switch device 40. Therefore, the clenching device 30 is configured to avoid making the clench wrench 10 too thick or not compact.

In view of the forgoing, the clench wrench 10 is configured to be engagable with an object, and the clenching device 30 can move to a position capable of preventing the object from disengaging from the clench wrench 10, as shown in FIGS. 4 and 6. Furthermore, the clenching device 30 can detach from the object.

The foregoing is merely illustrative of the principles of this invention, and various modifications can be made by those skilled in the art without departing from the scope and spirit of the invention.

What is claimed is:

1. A clench wrench comprising:

a structure defining a first body defining a handle for a user of the clench wrench to grasp and a second body integrated with the first body and defining an engaging head respectively, wherein the second body has two opposite sides with one side defining a front side and another side defining a back side respectively and includes an engaging space for engaging an object to be driven by the clench wrench, wherein the engaging space extends through the front and back sides and an opening is defined on both the front and back sides, wherein one of the front and back sides includes a clenching member of a clenching device connected thereto, wherein the clenching member is selectively movable between a first position blocking the opening of the engaging space adjacent to the one of the front and back sides and being capable of preventing the object engaged with the engaging space from disengaging therefrom, and a second position in which the opening of the engaging space adjacent to the one of the front and back sides is not blocked, wherein the clenching member is connected to the one of the front and back sides of the second body by a pivot of the clenching device and being pivotal about a pivot axis, with the pivot inserting through a through hole defined by the clenching member and fixed to a first engaging hole defined by the second body; and a positioning device interacted with the clenching device and configured to limit positions of the clenching member between the first and second positions thereof, wherein the clenching member is limited by a limiter of the positioning device, with the limiter inserted through a groove defined by the clenching member and fixed to a second engaging hole defined by the second body, and wherein the groove is curved and elongated and has a center of curvature located on the pivot axis.

2. The clench wrench as claimed in claim 1, wherein the engaging space is defined by an inner periphery of a ratchet wheel, wherein the ratchet wheel is disposed in a compartment defined by an inner periphery of the second body, wherein the ratchet wheel is rotatable and has a center of rotation on an axis, and wherein the axis extends in a thickness direction of the second body.

3. The clench wrench as claimed in claim 2 further comprising a switch device interacted with the ratchet wheel and configured to releasably stop the ratchet wheel from rotation, and wherein the switch device includes an input control exposed on the second body.

4. The clench wrench as claimed in claim 1, wherein the clenching member is a thin plate that has a substantially smaller thickness than a thickness of the second body.

5. The clench wrench as claimed in claim 4 further comprising a switch device interacted with the ratchet wheel and configured to releasably stop the ratchet wheel from rotation, wherein the switch device includes an input control exposed on the second body, and wherein the clenching member has a thickness not greater than that of the input of the switch.

6. The clench wrench as claimed in claim 1, wherein the clenching member has a main body selectively blocking the opening of the engaging space, wherein the opening of the engaging space is selectively blocked by a bottom side of the main body as well as by a segment of a lateral edge of the main body, and wherein the lateral edge extends upwardly from the bottom side and on a periphery of the bottom side.

7. The clench wrench as claimed in claim 6, wherein the clenching member forms a lever protruding upwardly from the main body thereof.

8. The clench wrench as claimed in claim 6, wherein the engaging space is defined by an inner periphery of a ratchet wheel, wherein the ratchet wheel is disposed in a compartment defined by an inner periphery of the second body, wherein the ratchet wheel is rotatable and has a center of rotation on an axis, and wherein the axis extends in a thickness direction of the second body.

9. The clench wrench as claimed in claim 8 further comprising a switch device interacted with the ratchet wheel and configured to releasably stop the ratchet wheel from rotation, and wherein the switch device includes an input control exposed on the second body.

10. The clench wrench as claimed in claim 9, wherein the lateral edge of the main body of the clenching member has a second segment having a concave contour to avoid interfering with the operation of input control.

* * * * *